US009004656B2

(12) United States Patent
Takahagi et al.

(10) Patent No.: US 9,004,656 B2
(45) Date of Patent: Apr. 14, 2015

(54) INK-JET RECORDING HEAD AND INK-JET RECORDING APPARATUS HAVING THE SAME

(71) Applicants: Hiroshi Takahagi, Kanagawa (JP); Makoto Shinohara, Kanagawa (JP); Hideaki Mamiya, Kanagawa (JP); Takeshi Shimizu, Kanagawa (JP); Takashi Tomita, Kanagawa (JP); Hiroshi Azami, Kanagawa (JP)

(72) Inventors: Hiroshi Takahagi, Kanagawa (JP); Makoto Shinohara, Kanagawa (JP); Hideaki Mamiya, Kanagawa (JP); Takeshi Shimizu, Kanagawa (JP); Takashi Tomita, Kanagawa (JP); Hiroshi Azami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/975,669

(22) Filed: Aug. 26, 2013

(65) Prior Publication Data

US 2014/0063138 A1 Mar. 6, 2014

(30) Foreign Application Priority Data

Aug. 31, 2012 (JP) ..... 2012-192325

(51) Int. Cl.
*B41J 2/175* (2006.01)

(52) U.S. Cl.
CPC ..... *B41J 2/175* (2013.01)

(58) Field of Classification Search
USPC ..... 347/85, 89
See application file for complete search history.

(56) References Cited

U.S. PATENT DOCUMENTS

| | | | | |
|---|---|---|---|---|
| 5,030,973 | A | 7/1991 | Nonoyama et al. | |
| 2006/0132554 | A1 * | 6/2006 | Ota et al. | 347/85 |
| 2006/0158494 | A1 * | 7/2006 | Yamanobe | 347/96 |
| 2008/0084464 | A1 | 4/2008 | Saga et al. | |

FOREIGN PATENT DOCUMENTS

| | | |
|---|---|---|
| EP | 1911593 A2 | 4/2008 |
| JP | 11-192721 | 7/1999 |
| JP | 2001-232808 | 8/2001 |
| JP | 2003-211688 | 7/2003 |
| JP | 2009-184183 | 8/2009 |

OTHER PUBLICATIONS

European Search Resort dated Nov. 14, 2013 in corresponding. European patent application No. 13 18 2263.7, date unavailable.

* cited by examiner

*Primary Examiner* — Stephen Meier
*Assistant Examiner* — Alexander D Shenderov
(74) *Attorney, Agent, or Firm* — Cooper & Dunham LLP

(57) ABSTRACT

An ink-jet recording head includes a recording head and pressure damper assembly module including a recording head part at a lower position having nozzle holes on an under surface and an ink passage communicating with the nozzle holes, and a pressure damper part higher than the recording head part having an ink containing chamber inside. The ink-jet recording head further includes first flexible tube supplying ink in the ink containing chamber to the ink passage and connecting an ink discharge part communicating with the ink containing chamber and an ink supply part at one end side in the recording head part communicating with one end of the ink passage; and a second flexible tube connected with another end side in the recording head part and communicating with another end of the ink passage. At least the inside of the first flexible tube is filled with the ink.

15 Claims, 17 Drawing Sheets

INK-JET RECORDING HEAD AND INK-JET RECORDING APPARATUS HAVING THE SAME

BACKGROUND OF THE INVENTION

1. Field of the Invention

The present invention relates to an ink-jet recording head used in an ink-jet recording apparatus. In particular, the present invention relates to an ink-jet recording head that includes a reciprocating carriage, a recording head part and a pressure damper part, the recording head part and the pressure damper part being mounted in the carriage. The pressure damper part contains an ink and controls a pressure fluctuation of the ink.

2. Description of the Related Art

For example, concerning an ink-jet recording apparatus for business use, it is necessary to prepare a large-capacity ink tank for the purpose of carrying out a large amount of printing, and the ink tank is mounted in a tank holder that is provided at a body side of the ink-jet recording apparatus.

Meanwhile, a pressure damper part that can contain a predetermined amount of ink is provided in a carriage on which a recording head part is mounted. The ink tank and the pressure damper part are connected by an ink supply tube.

For example, Japanese Laid-Open Patent Application No. 2003-211688 and Japanese Laid-Open Patent Application No. 2009-184183 discuss such ink-jet recording heads having pressure damper parts.

FIG. 19 shows a general configuration of an ink-jet recording head in the related art discussed by Japanese Laid-Open Patent Application No. 2003-211688 or the like.

As shown in FIG. 19, in the ink-jet recording head, a recording head part 101 is mounted at a lower part in a gravity direction (a vertical direction) of a recording head and pressure damper assembly module 100 which extends in the vertical direction. A pressure damper part 102 is mounted above the recording head part 101 in the gravity direction in the recording head and pressure damper assembly module 100.

In the configuration of FIG. 19, the pressure damper part 102 has a case member 104 and an ink containing chamber 103 is formed in the case member 104 by a recess part 105 and a flexible film member 106. The recess part 105 is formed at a part of the case member 104 and the flexible film member 106 closes a front opening of the recess part 105. An ink fluctuation is controlled by the ink containing chamber 103.

An ink introducing part 107 is provided above the pressure damper part 102 in the gravity direction for introducing an ink into the pressure damper part 102 from an ink tank (not shown).

Further, at a center of the bottom end in the gravity direction of the pressure damper part 102, a tubular connection part 108 extends toward the recording head part 101 for supplying the ink inside the pressure damper part 102 to the recording head part 101. Meanwhile, above the recording head part 101, an ink supply needle 109 is provided to extend vertically. As a result of inserting the ink supply needle 109 into the tubular connection part 108, the pressure damper part 102 and the recording head part 101 are connected.

In the ink-jet recording head of FIG. 19, inside the recording head and pressure damper assembly module 100 mounted in a carriage (not shown), the recording head part 101 is installed at the lower part and the pressure damper part 102 is installed above the recording head part 101, and connection members such as the tubular connection part 108 and the ink supply needle 109 are inserted therebetween.

Usually, the tubular connection part 108 and the ink supply needle 109 are formed of synthetic resin molds, and do not have flexibility in themselves. Further, since the connection members are inserted between the recording head part 101 and the pressure damper part 102 as mentioned above, a space 110 inevitably exists between the recording head part 101 and the pressure damper part 102. As a result, the pressure damper part 102 is away from the recording head part 101 by the length of the space 110, and the height H of the recording head and pressure damper assembly module 100 is increased accordingly.

Recently, a demand has been increased for high-speed printing on paper sheets having large areas. For this purpose, there has been a tendency to increase the scanning range and the scanning speed of the carriage. In such a tendency, it is necessary to reduce the height H of the recording head and pressure damper assembly module as much as possible for the purpose of effectively controlling the pressure fluctuation in the ink contained in the recording head and pressure damper assembly module. However, it may be difficult for the ink-jet recording head shown in FIG. 19 in the related art to meet the condition.

SUMMARY OF THE INVENTION

According to one embodiment of the present invention, an ink-jet recording head includes a recording head and pressure damper assembly module that includes a recording head part that has a plurality of nozzle holes on an under surface and an ink passage communicating with the plurality of nozzle holes, and a pressure damper part that has an ink containing chamber inside, wherein the recording head part is mounted at a position of a lower side in a gravity direction, and the pressure damper part is placed higher in the gravity direction than the recording head part. The ink-jet recording head further includes a first flexible tube for supplying ink contained in the ink containing chamber of the pressure damper part to the ink passage of the recording head part, the first flexible tube connecting an ink discharge part communicating with the ink containing chamber of the pressure damper part and an ink supply part at one end side in the recording head part and communicating with one end of the ink passage; and a second flexible tube connected with another end side in the recording head part and communicating with another end of the ink passage. In this configuration, at least the inside of the first flexible tube is filled with the ink.

Other objects, features and advantages of the present invention will become more apparent from the following detailed description when read in conjunction with the accompanying drawings.

DETAILED DESCRIPTION OF THE EMBODIMENTS

Below, the embodiments of the present invention will be described using drawings.

(First Embodiment)

Figure 10:
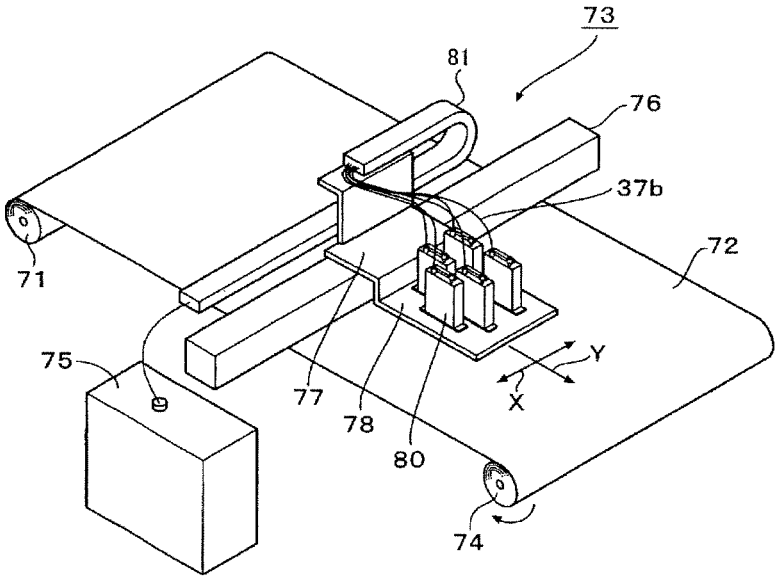
FIG. 10 shows a perspective view of the entire configuration of an ink-jet recording apparatus according to each of the first embodiment and a second embodiment.
Figure 11A:
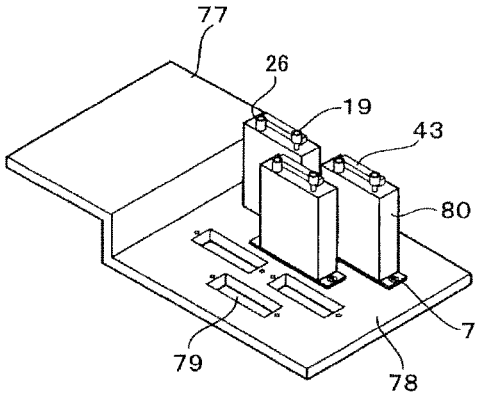
FIGS. 11A and 11B show perceptive views of a carriage used in the ink-jet recording apparatus of FIG. 10.
Figure 11B:
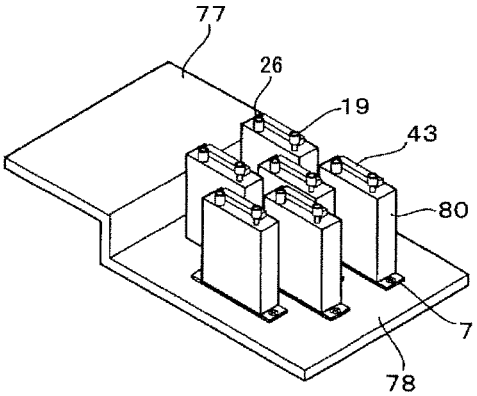

FIG. 10 shows a perspective view of the entire configuration of an ink-jet recording apparatus according to the first embodiment, and FIGS. 11A and 11B show perceptive views of a carriage used in the ink-jet recording apparatus.

As shown in FIG. 10, a continuous recording medium (continuous paper sheet) 72 is intermittently unwound from a paper supply part 71 at high speed, a desired image is then printed on the continuous recording medium 72 at an ink-jet recording part 73, and then, the continuous recording medium 72 is wound onto and is collected to a paper collecting part 74.

The ink-jet recording part 73 includes an ink tank 75 installed at a body side in an ink-jet recording apparatus; a direct movement guide 76 extending along a width direction (a X-direction) of the recording medium 72; a carriage 77 reciprocating at high speed along the width directions (X-directions) of the recording medium 72 along the direct movement guide 76; and a cableveyor (registered trademark) 81.

As shown in FIG. 11A, staggered recording head mounting openings 79 each having a rectangular shape along a direction of conveying the recording medium 72 (a Y-direction, see FIG. 10) are formed in a plurality of rows in a flat part 78 of the carriage 77, the flat part 78 facing the recording medium 72. bower end parts of the recording head and pressure damper assembly modules 80 are fitted and attached to the respective recording head mounting openings 79 (see FIG. 11B).

Figure 1:
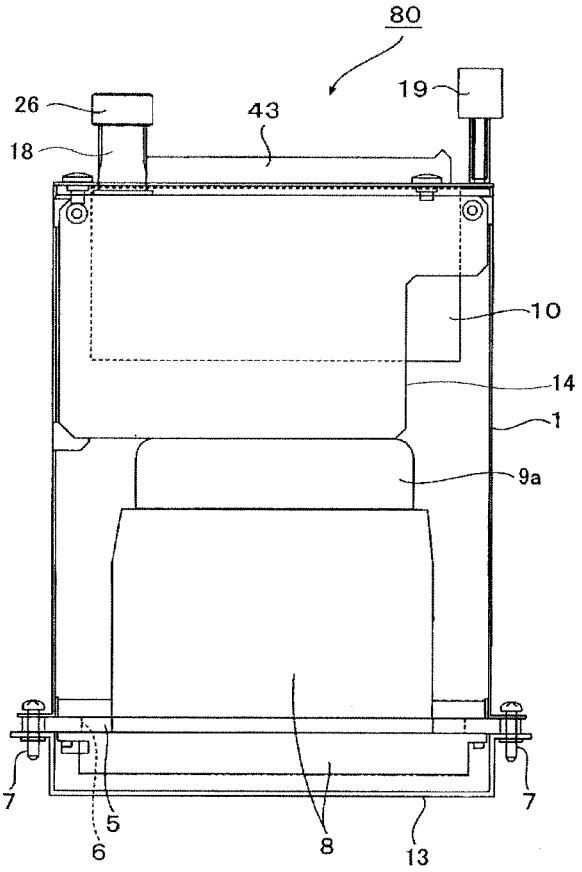
FIG. 1 shows a general front elevation of the entire configuration of a recording head and pressure damper assembly module according to a first embodiment.
Figure 2:
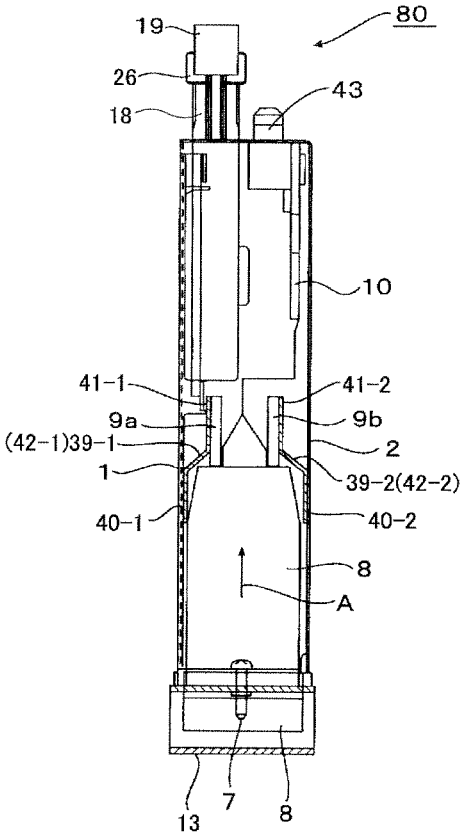
FIG. 2 shows a general sectional view of the recording head and pressure damper assembly module.
Figure 3:
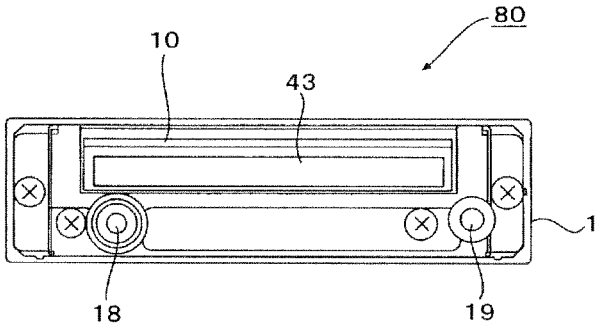
FIG. 3 shows a general top view of the recording head and pressure damper assembly module.
Figure 4A:
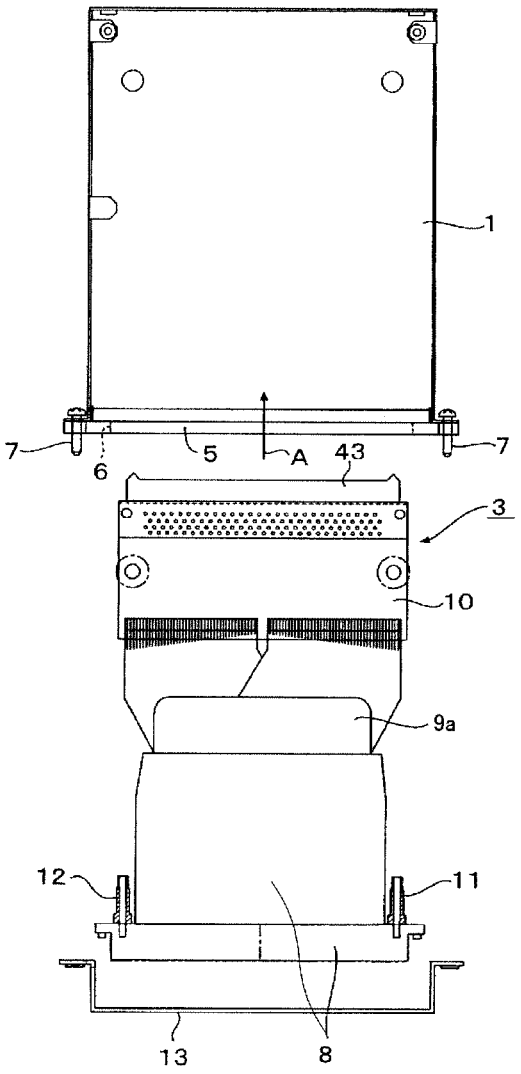
FIG. 4A shows a front elevation of a frame and a recording head module in a state of the recording head and pressure damper assembly module having been disassembled.
Figure 4B:
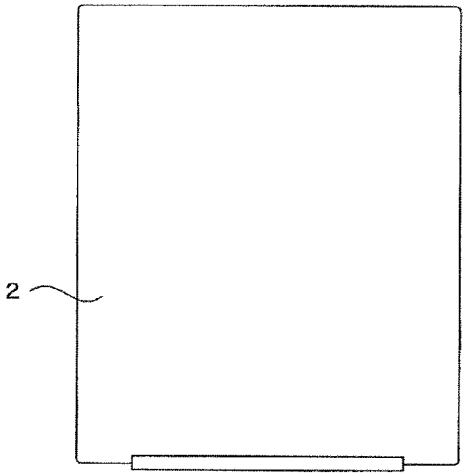
FIG. 4B shows a front elevation of a cover used in the recording head and pressure damper assembly module.
Figure 4C:
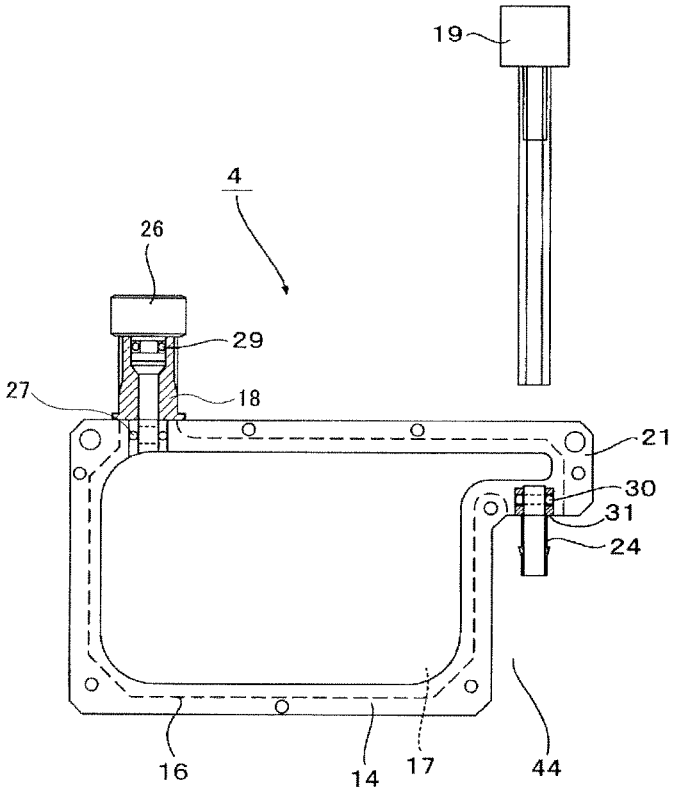
FIG. 4C shows a front elevation of a pressure damper module used in the recording head and pressure damper assembly module.

FIG. 1 shows a general front elevation of the entire configuration of the recording head and pressure damper assembly module 80 according to the first embodiment. FIG. 2 shows a general sectional view of the recording head and pressure damper assembly module 80. FIG. 3 shows a general top view of the recording head and pressure damper assembly module 80. FIG. 4A shows a front elevation of a frame 1 and a recording head module 3 in a state of the recording head and pressure damper assembly module 80 having been disassembled. FIG. 4B shows a front elevation of a cover 2 used in the recording head and pressure damper assembly module 80. FIG. 4C shows a front elevation of a pressure damper module 4 used in the recording head and pressure damper assembly module 80. It is to be noted that FIG. 1 shows the view of the state of the cover 2 having been removed.

An inside space is formed by the frame 1 (see FIG. 4A) approximately having a box shape and the cover 2 (see FIG. 4B) that closes a front opening of the frame 1. The recording head module 3 (see FIG. 4A) is inserted and installed in a lower area in a gravity direction (vertical direction) of the inside space and the pressure damper module 4 (see FIG. 4C) is inserted and installed in a higher area in the gravity direction (vertical direction) of the inside space.

The cover 2 is provided for the purpose of preventing ink mist from adhering to the recording head and pressure damper assembly module 80, and is made of stainless steel having resistance to ink. By thus using such a material having resistance to ink, the cover 2 is less corrosive even if inks of various compositions are used.

As shown in FIG. 1, a head base 5 is mounted to a bottom part of the frame 1 by spot welding, and an opening 6 is formed in the head base 5 for inserting the recording head module 3 therethrough. Further, module attaching screws 7 are mounted to point downward at both ends of the head base 5 for the purpose of attaching the recording head and pressure damper assembly module 80 to the carriage 77 (see FIG. 11B).

As shown in FIG. 4A, the recording head module 3 includes the recording head body 8; two head radiator plates 9*a* and 9*b* (see FIG. 2) connected with the recording head body 8; an interconnection substrate 10 also connected with the recording head body 8; a head part ink supply pipe 11 installed vertically on the recording head body 8 at a right side end thereof in FIG. 4A; a head part air vent pipe 12 installed vertically on the recording head body 8 at a left side end thereof in FIG. 4A; a connector 43 (FIGS. 2 and 3) connected with the interconnection substrate 10; and a head cover 13. They are arranged and connected as shown in FIGS. 1, 2, 3 and 4A.

Figure 20:
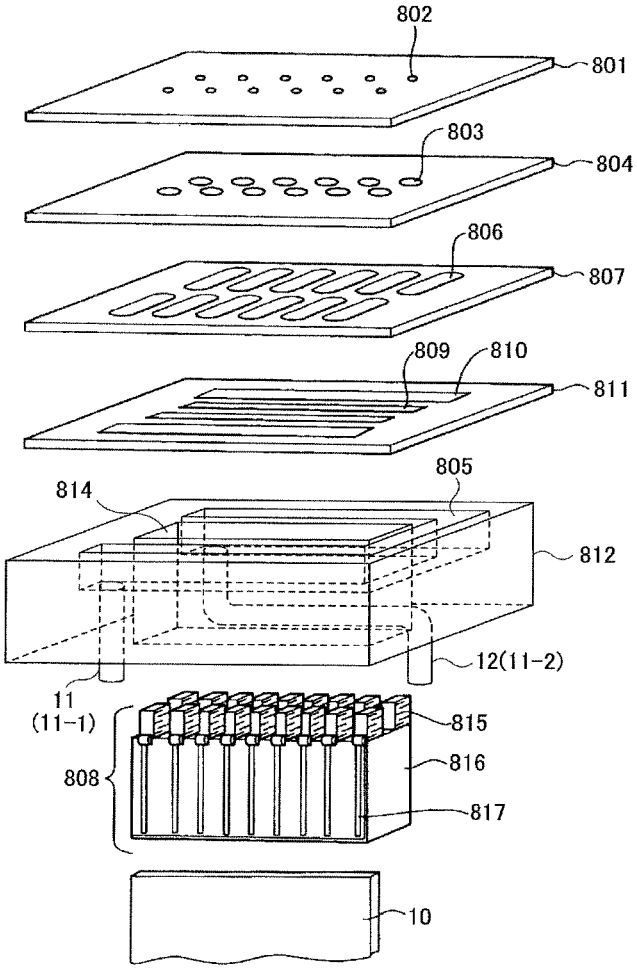
FIG. 20 shows an exploded perspective view of one example of a recording head body according to the first embodiment and the second embodiment.

As shown in FIG. 20, on the under surface of the recording head body 8, many ink nozzle holes 802 that discharge ink droplets are formed in rows. Further, inside the recording head body 8, a nozzle plate 801, a pressure chamber plate 804, a restrictor plate 807, a diaphragm plate 811, a rigid plate 812 and piezoelectric elements 808 are contained and installed. It is to be noted that FIG. 20 shows the recording head body 8 upside down. That is, the nozzle plate 801 placed at the top in FIG. 20 corresponds to the under surface of the recording head body 8.

In the configuration of FIG. 20, the pressure chamber plate 804, the restrictor plate 807, the diaphragm plate 811 and the rigid plate 812 are joined to the nozzle plate 801 in which the nozzle holes 802 are formed. Pressure chambers 803 are formed in the pressure chamber plate 804, and restrictors 806 are formed in the restrictor plate 807. The restrictors 806 connect a common ink passage 805 and the pressure chambers 803, and control the flows of the ink into the pressure chambers 803. It is to be noted that the common ink passage 805, the restrictors 806 and the pressure chambers 803, as a whole, function as an ink passage that communicates with the nozzle holes 802.

The diaphragm plate 811 has elasticity and includes vibration plates 809 and filters 810. The vibration plates 809 efficiently transmit displacement of the piezoelectric elements 808 to the pressure chambers 803. The filters 810 filter out dirt/dust included in the ink that flows into the restrictors 806 from the common ink passage 805. Also the common ink passage 805 is formed in the rigid plate 812.

In the rigid plate 812, also the head part ink supply pipe 11 and the head part air vent pipe 12, communicating with the common ink passage 805 at both ends thereof, respectively, are formed. Further, piezoelectric element storage part 814 is formed in the rigid plate 812 for storing the piezoelectric elements 808 therein.

The piezoelectric elements 808 include many laminated piezoelectric vibrators 815 and a nonconductive attaching member 816 having conductive patterns, and the piezoelectric vibrators 815 are attached to the attaching member 816. The laminated piezoelectric vibrators 815 are arranged to correspond to the respective pressure chambers 803. Also external electrodes 817 including individual electrodes and a common electrode for transmitting separate electric signals to the laminated piezoelectric vibrators 815 are formed in the attaching member 816.

To the side surface of the attaching member 816 on which the external electrodes 817 are formed, the interconnection substrate 10 on which a piezoelectric element driving IC not shown) is mounted is attached and connected.

In the configuration of FIG. 20, the electric signals are provided to the piezoelectric elements 808 via the piezoelectric element driving IC and the external electrodes 817, and thereby, distortion occurs in the laminated piezoelectric vibrators 815. As a result, the vibration plates 809 vibrate, the internal pressures in the pressure chambers 803 are thus changed, and the ink contained in the pressure chambers 803 are discharged as ink droplets through the nozzle holes 802.

After the space and the positional relationship between the head base 5 and the recording head body 8 are adjusted, the recording head body 8 is attached to the head base 5 using screws, and is stuck to the head base 5 using an adhesive that also functions as an ink sealant.

According to the first embodiment, the two head radiator plates 9*a* and 9*b* are installed at front and back sides, and have a function of effectively moving away heat generated from the piezoelectric element driving IC and/or the like provided in a driving part inside the recording head body 8. The mechanism of radiation will be described later using FIG. 2.

As shown in FIG. 4A, the head part ink supply pipe 11 and the head part air vent pipe 12 are installed at both end parts of the recording head body 8. The head part ink supply pipe 11 communicates with one end of the ink passage formed inside the recording head body 8. The head part air vent pipe 12 communicates with another end of the ink passage. It is to be noted that, as described above using FIG. 20, actually, the head part ink supply pipe 11 communicates with one end of the common ink passage 805, the head part air vent pipe 12 communicates with another end of the common ink passage 805, and the ink nozzle holes 802 communicate with the ink passage that includes the common ink passage 805.

The head cover 13 is used for protecting the nozzle surface of the recording head body 8 at a time of shipping and transportation of the ink-jet recording apparatus. As shown in FIG. 1, both end parts of the head cover 13 are mounted to the frame 1 detachably using the module attaching screws 7. The head cover 13 is removed when the ink-jet recording apparatus is shipped as a product.

The pressure damper module 4 has a case member 14 made of a mold of synthetic resin such as polyethylene. A recess part 15 (see FIG. 5) is formed in the pressure damper module 4 from the front side in such a manner that almost all of the pressure damper module 4 is hollowed out. The front opening of the recess part 15 is closed by a flexible film member 16 made of synthetic resin, and thus, an ink containing chamber 17 is formed inside the case member 14.

A pressure damper part ink supply pipe 18 is provided at one end of an upper part in the gravity direction of the case member 14.

Figure 5:
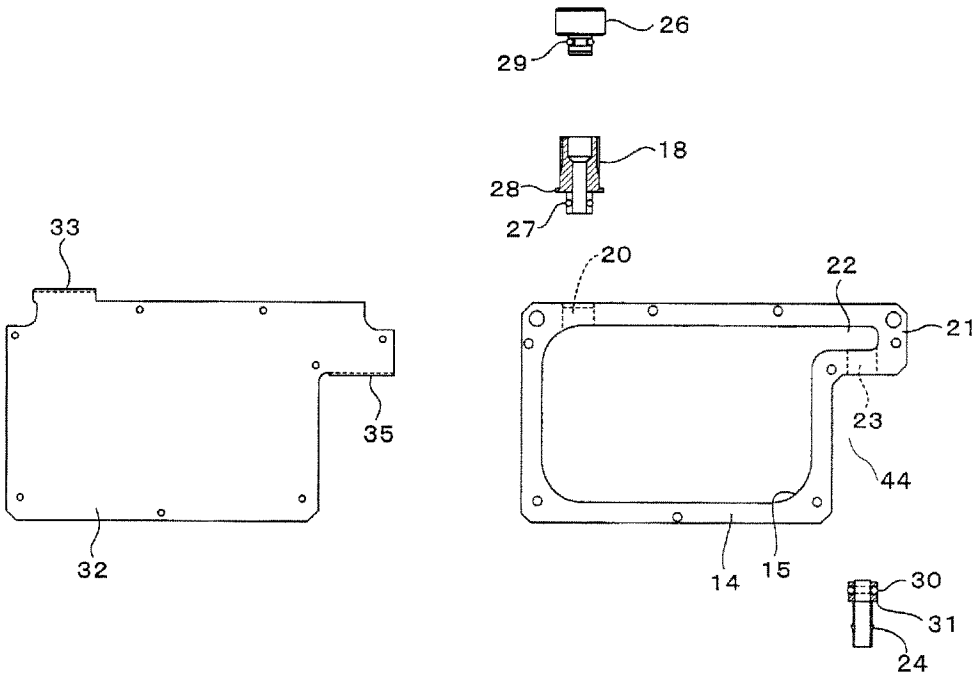
FIG. 5 shows a front elevation of the pressure damper module used in the recording head and pressure damper assembly module in a state the pressure damper module having been disassembled.

As shown in FIG. 5, an ink supply pipe insertion hole 20 for pressing thereinto to mount the pressure damper part ink supply pipe 18 is formed at the one end of the upper part in the gravity direction of the case member 14. The opening of the ink supply pipe insertion hole 20 at the lower end communicates with the recess part 15 (the ink containing chamber 17).

A projection 21 is formed to project outward as being perpendicular to the gravity direction at the other end of the upper part in the gravity direction of the case member 14. Inside the projection 21, an ink discharge passage 22 that communicates with the recess part 15 (ink containing chamber 17) and an ink discharge pipe insertion hole 23 that communicates with the ink discharge passage 22 are formed. A pressure damper part ink discharge pipe 24 is pressed and mounted to the ink discharge pipe insertion hole 23. Thus, the pressure damper part ink discharge pipe 24 is placed in a step part 44 (see FIGS. 4C, 5 and 6) on a side of the case member 14 below the projection 21.

The position of the lower end opening of the ink supply pipe insertion hole 20 formed in the case member 14 and the position of the ink discharge passage 22 are approximately at the same level in the gravity direction (vertical direction) (approximately the same height), and the recess part 15 (ink containing chamber 17) is below them in the gravity direction.

Figure 6:
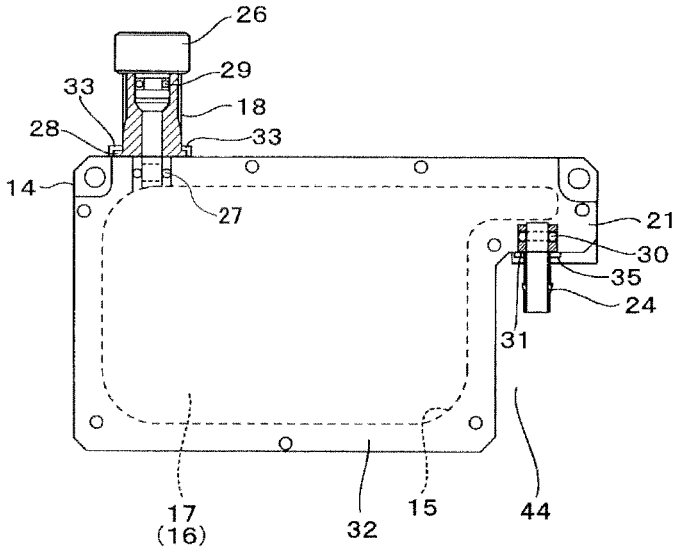
FIG. 6 shows a front elevation of the pressure damper module after being assembled.

In the case of the first embodiment, as shown in FIGS. 5 and 6, an O-ring 27 is mounted at a lower end part of the pressure damper part ink supply pipe 18, and a flange part 28 is provided at an intermediate position thereof. A cap 26 to be used at a time of transportation is fitted to the top part of the pressure damper part ink supply pipe 18, and an O-ring 29 is mounted at a lower part of the cap 26. The cap 26 is used at a time of transportation of the ink-jet recording head. When the ink-jet recording head is mounted in the ink-jet recording apparatus, the cap 26 is removed from the pressure damper part ink supply pipe 18.

The lower end part of the pressure damper part ink supply pipe 18 is pressed into the ink supply pipe insertion hole 20 formed in the case member 14, and the flange part 28 of the pressure damper part ink supply pipe 18 is in contact with the top surface of the case member 14 (see FIG. 6).

Meanwhile, an O-ring 30 is mounted at an upper end part of the pressure damper part ink discharge pipe 24, and a circumferential step part 31 is formed at an intermediate part of the pressure damper part ink discharge pipe 24. By pressing the pressure damper part ink discharge pipe 24 into the ink discharge pipe insertion hole 23 of the case member 14, the step part 31 is exposed as being approximately flush with the under surface of the projection 21 (see FIG. 6).

According to the first embodiment, the pressure damper part ink supply pipe 18 and the pressure damper part ink discharge pipe 24 are mounted to the case member 14 using press-fit technology. It is also possible to mount the pressure damper part ink supply pipe 18 and the pressure damper part ink discharge pipe 29 to the case member 14 using insert molding technology. However, if insert molding technology were used, it would be necessary to prepare respective case members 14 with pressure damper part ink supply pipes 18 and pressure damper part ink discharge pipes 24 using insert molding technology to be used for ink-jet recording apparatuses of various apparatus types in a case where the shapes, sizes and/or the like of the pressure damper part ink supply pipes 18 and pressure damper part ink discharge pipes 24 are somewhat different thereamong. Thus, the costs would be increased. In contrast thereto, by mounting the pressure damper part ink supply pipe 18 and the pressure damper part ink discharge pipe 24 using press-fit technology as in the first embodiment, it is possible to use case members 14 in the same type in common for ink-jet recording apparatuses of various apparatus types, and it is possible to reduce the costs and make the assembling works more efficient.

By providing the film member 16 on one side of the ink containing chamber 17 as described above, it is possible that the ink containing chamber 17 provides a damper function using flexibility of the film member 16. A film cover 32 is placed on the outside of the film member 16 for preventing the film member 16 to be excessively stretched (see FIGS. 5 and 6).

The film cover 32 is made of a metal plate or a synthetic resin mold, a planar shape of which is approximately the same as the case member 14, as shown in FIG. 5. The film cover 32 is attached to the case member 14 in a manner of covering the top surface of the film member 16.

Figure 7:
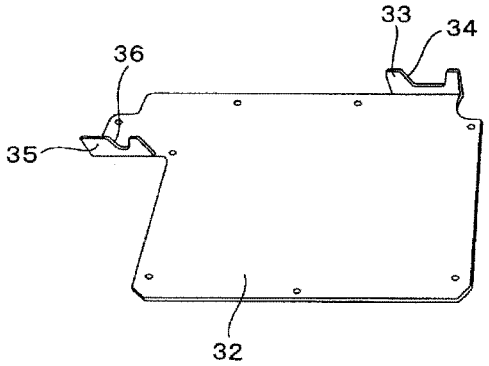
FIG. 7 shows a perspective view of a film cover used in the pressure damper module in a state of having been reversed.

FIG. 7 shows a perspective view of the film cover 32 in a state of having been reversed.

As shown in FIG. 7, the film cover 32 has an ink supply pipe retaining part 33 extending perpendicularly at a position corresponding to the pressure damper part ink supply pipe 18, and a cut-out part 34 having approximately an arc shape is formed at an extending end part of the ink supply pipe retaining part 33. The film cover 32 further has an ink discharge pipe retaining part 35 extending perpendicularly at a position corresponding to the pressure damper part ink discharge pipe 24, and a cut-out part 36 having approximately an arc shape is formed at an extending end part of the ink discharge pipe retaining part 35. As shown in FIG. 7, the ink supply pipe retaining part 33 and the ink discharge pipe retaining part 35 face one another in a diagonally opposite manner.

When putting the film cover 32 on the case member 14 (film member 16) and attaching it, the ink supply pipe retaining part 33 is fitted to the periphery of the pressure damper part ink supply pipe 18, is engaged with the flange part 28 of the pressure damper part ink supply pipe 18, and thus, can prevent the pressure damper part ink supply pipe 18 from being removed. Also, the ink discharge pipe retaining part 35 is fitted to the periphery of the pressure damper part ink discharge pipe 24, is engaged with the step part 31 of the pressure damper part ink discharge pipe 24, and thus, can prevent the pressure damper part ink discharge pipe 24 from being removed (see FIG. 6).

According to the first embodiment, the flange part 28 is provided to the pressure damper part ink supply pipe 18 and the step part 31 is provided to the pressure damper part ink discharge pipe 24. However, in reverse, it is also possible to provide a step part to the pressure damper part ink supply pipe 18 and a flange part to the pressure damper part ink discharge pipe 24. Further alternatively, it is also possible to provide respective flange parts to both the pressure damper part ink supply pipe 18 and the pressure damper part ink discharge pipe 24 or respective step parts to both the pressure damper part ink supply pipe 18 and the pressure damper part ink discharge pipe 24.

Thus, according to the first embodiment, the film cover 32 is used to prevent the pressure damper part ink supply pipe 18 and the pressure damper part ink discharge pipe 24 from being removed, respectively. Therefore, it is possible to reduce the number of parts/components, reduce the assembling man-hours, and reduce the costs.

Figure 8:
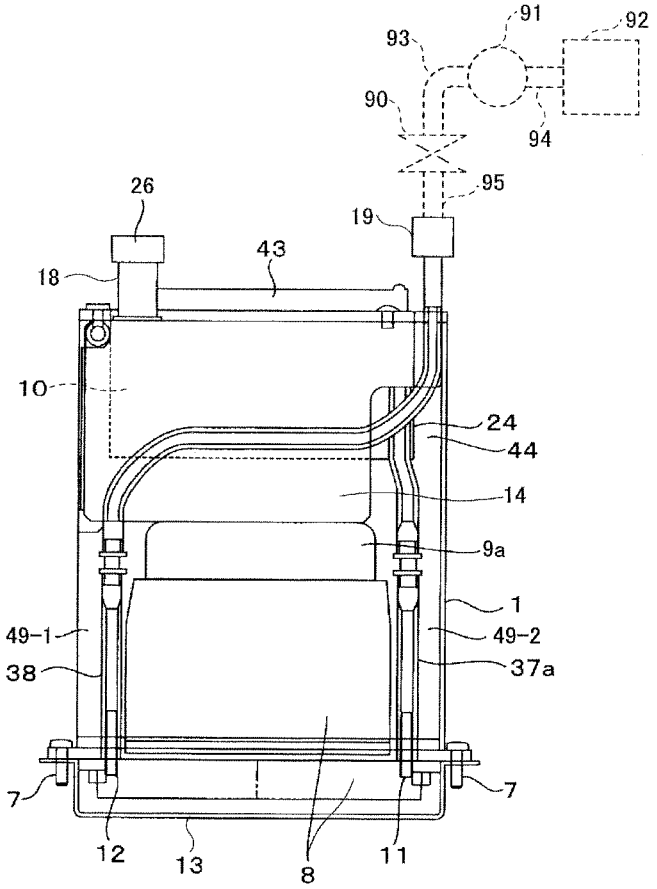
FIG. 8 illustrates a state of connection of an ink supply tube and an air vent tube in the recording head and pressure damper assembly module.

As shown in FIG. 8, a flexible head-side ink supply tube 37*a* is provided to connect the head part ink supply pipe 11 and the pressure damper part ink discharge pipe 24. Further, as shown in FIG. 10, a flexible tank-side ink supply tube 37*b* is provided to connect an ink discharge pipe on the side of the ink tank 75 provided on the body side of the ink-jet recording apparatus and the pressure damper part ink supply pipe 18.

The head part air vent pipe 12 is connected with a flexible air vent tube 38. At the other end of the air vent tube 38, a sealing valve 19 is provided, and thus, the other end of the air vent tube 38 is in a sealed state. The other end of the air vent tube 38 is fixed at an upper part of the frame 1 (higher than the pressure damper module 4).

In a case where air bubbles accumulated inside the recording head module 3 or the air vent tube 38 are to be discharged, a waste tank 92 is connected with the air vent tube 38 or the sealing valve 19 via an open valve 90, a suction pump 91 and connecting tubes 93, 94 and 95. Then, the suction pump 91 is driven and the open valve 90 (and the sealing value 19 if it is connected) is (are) opened. As a result, the air bubbles are forcibly discharged to the waste tank 92 via the open valve 90(and the sealing value 19 if it is connected), the suction pump 91 and the connecting tubes 93, 94 and 95.

When ink is supplied to the ink-jet recording head from the ink tank 75, air inside the pressure damper module 4 and the recording head module 3 is discharged to the outside of the ink-jet recording head via the head part air vent pipe 12 and the air vent tube 38, while the sealing valve 19 is opened. Instead, the ink is charged into the ink-jet recording head, in the stated order of the ink tank 75, the tank-side ink supply tube 37*b*, the pressure damper part ink supply pipe 18, the ink containing chamber 17 of the pressure damper module 4, the pressure damper part ink discharge pipe 24, the head-side ink supply tube 37*a*, the head part ink supply pipe 11 and the ink passage of the recording head module 3.

After the charging of the ink has been finished, such a state is obtained that the inside of the air vent tube 38 as well as the inside of the head-side ink supply tube 37*a* are filled with the ink. It is to be noted that, both the head-side ink supply tube 37*a* and the air vent tube 38 have flexibility.

Further, as shown in FIG. 8, since the head part ink supply pipe 11 and the head part air vent pipe 12 are provided, respectively, at both ends of the recording head body 8, it is possible to place the head-side ink supply tube 37*a* and the air vent tube 38 easily in spaces 49-1 and 49-2 between the side surfaces of the recording head body 8 and the side plates of the frame 1.

Thereby, in addition to the ink containing chamber 17 having the film member 16, also the flexible head-side ink supply tube 37*a* and the flexible air vent tube 38 near the recording head body 8 can provide the damper effect.

Figure 19:
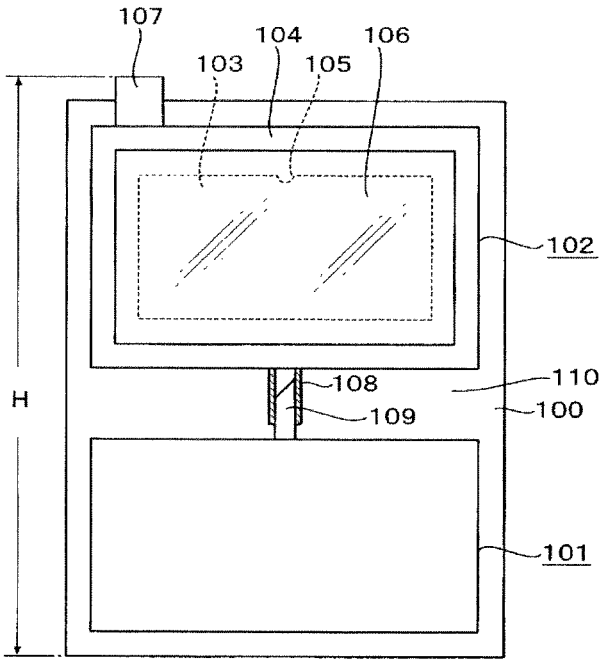
FIG. 19 shows a general configuration view of an ink-jet recording head in the related art.

Further, as shown in FIG. 8, the direction of arranging the recording head body 8, the head-side ink supply tube 37*a* and the air vent tube 38 is perpendicular to the gravity direction, i.e., is a side-by-side direction, it is possible to reduce the height of the recording head and pressure damper assembly module 80 in comparison to the related art shown in FIG. 19, and thus, it is possible to reduce the inertia force of the carriage 77.

In order to effectively radiate the heat generated by the piezoelectric element driving IC or the like provided in the driving part inside the recording head body 8, respective heat conduction plates 39-1 and 39-2 are inserted, as shown in FIG. 2, between the frame 1 and the head radiator plate 9*a* facing it and between the cover 2 and the head radiator plate 9*b* facing it.

Figure 9:
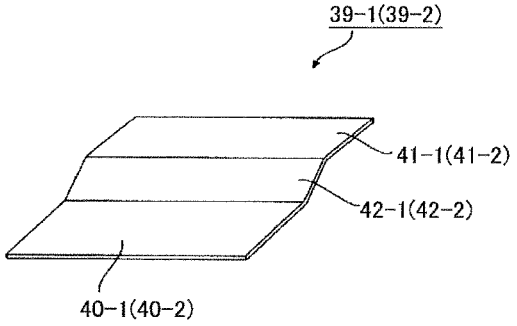
FIG. 9 shows a perspective view of a heat conduction plate used in the first embodiment.

The heat conduction plates 39-1 and 39-2 are made from a plate material having good heat conduction such as copper, aluminium or the like, for example. As shown in FIG. 9, the heat conduction plate 39-1 includes a base end part 40-1, an elastically contacting part 41-1 at a free end side and a connection part 42-1 connecting them, side by side. The base end part 40-1 and the electrically contacting part 41-1 are arranged approximately in parallel, and the connection part 42-1 is inclined between the base end part 40-1 and the elastically contacting part 41-1. The heat conduction plate 39-2 has the same structure and includes a base end part 40-2, an elastically contacting part 41-2 and a connection part 42-2.

When the ink-jet recording head is assembled, the base end parts 40-1, 40-2 of the two heat conduction plates 39-1 and 39-2 are fixed at several points of the frame 1 and the cover 2, respectively, at facing positions by spot welding or the like. Thereby, the distance between the respective connection parts 42-1 and 42-2 is gradually reduced along the direction toward the elastically contacting parts 41-1 and 41-2, in a manner of a tapered shape. In this state, the recording head module 3 is inserted into the frame 1 via the opening 6 of the head base 5 in the direction of the arrow "A" while the head radiator plates 9 are inserted in the lead.

The extending ends of the head radiator plates 9*a*, 9*b* thus come into contact with the inclined surfaces of the connection parts 42-1, 42-2 of the tapered shape. Then, by further inserting the recording head module 3 to a predetermined position in the frame 1, the connection parts 42-1, 42-2 are pressed outward to slightly move away from one another, the elastic resilience force is thus generated in the connection parts 42-1, 42-2, and thereby, the connection parts 42-1, 42-2 of the heat conduction plates 39-1, 39-2 are satisfactorily in contact with the head radiator plates 9*a*, 9*b* (see FIG. 2).

As a result, the heat from the head radiator plates 9*a*, 9*b* is transmitted through the two heat conduction plates 39-1 and 39-2, respectively, and radiates from the frame 1 and the cover 2 having the areas larger than the head radiator plates 9*a* and 9*b* and the heat conduction plates 39-1 and 39-2. Therefore, it is possible to avoid various troubles concerning printing (for example, a damage in the recording head body 8 and an accompanying failure in discharge of ink droplets) that may otherwise occur if the heat generated in the recording head module 3 remains inside.

(Second Embodiment)

Figure 12:
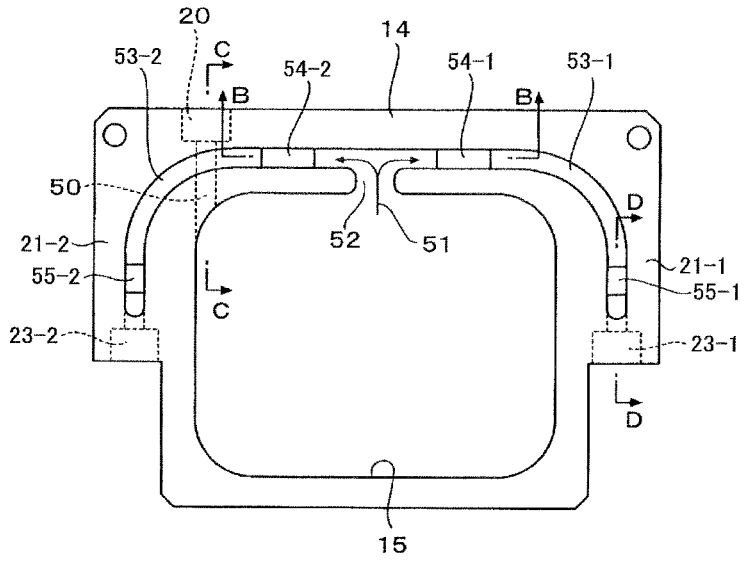
FIG. 12 shows a front elevation of a case member used in a pressure damper module according to the second embodiment.
Figure 13:
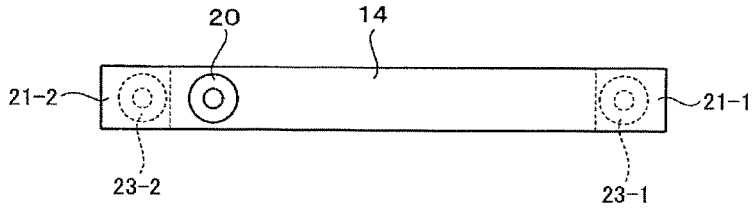
FIG. 13 shows a top view of the case member.
Figure 14:
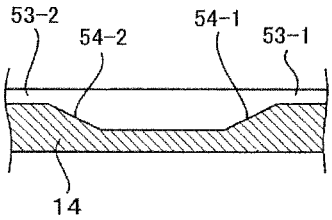
FIG. 14 shows a sectional view taken along a B-B line of FIG. 12.
Figure 15:
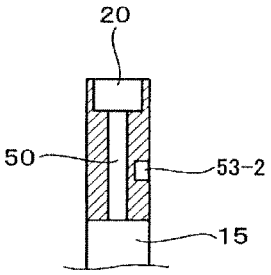
FIG. 15 shows a sectional view taken along a C-C line of FIG. 12.
Figure 16:
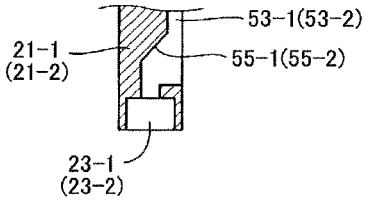
FIG. 16 shows a sectional view taken along a D-D line of FIG. 12.
Figure 17:
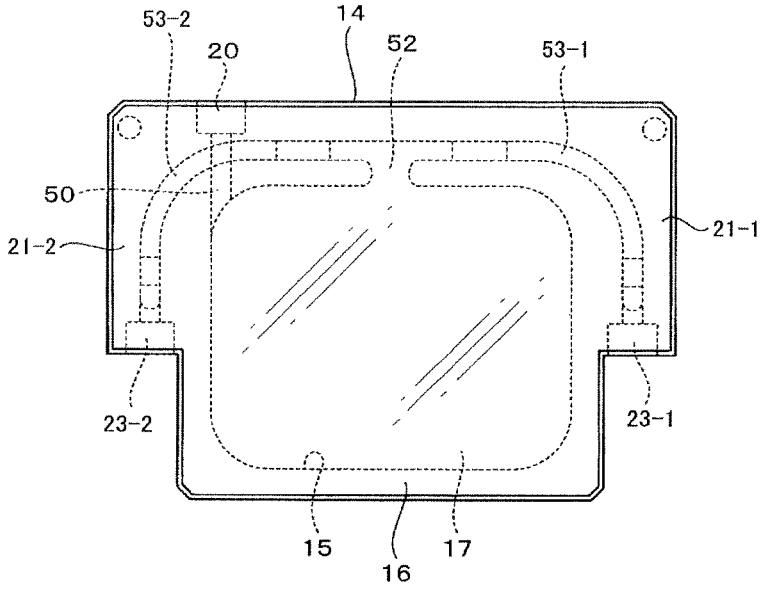
FIG. 17 shows a front elevation of a state of a film member having been affixed onto the case member.
Figure 18:
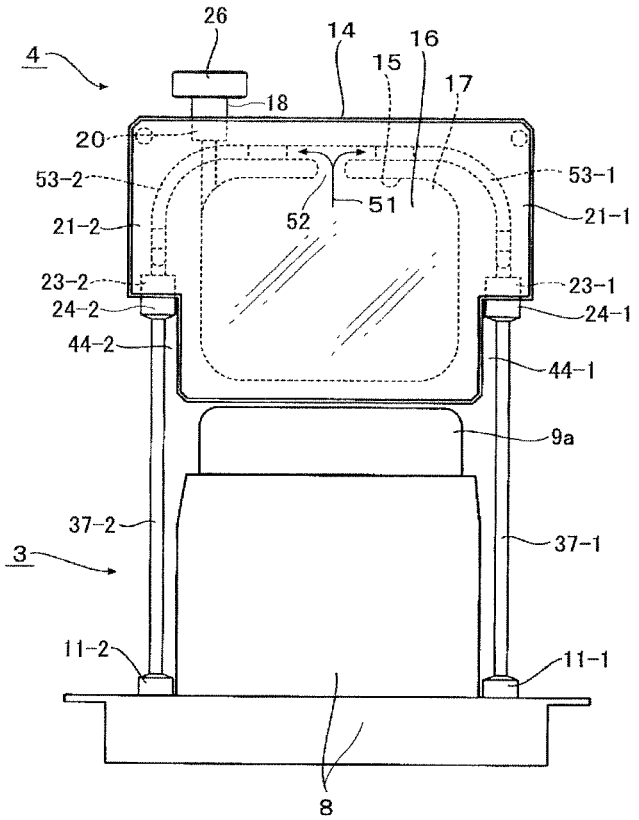
FIG. 18 shows a front elevation of a state of a recording head module and the pressure damper module having been connected according to the second embodiment.

FIGS. 12 to 18 and 20 illustrate a second embodiment of the present invention. FIG. 12 shows a front elevation of a case member 14, FIG. 13 shows a top view of the case member 14, FIG. 14 shows a sectional view taken along a B-B line of FIG. 12, FIG. 15 shows a sectional view taken along a C-C line of FIG. 12, FIG. 16 shows a sectional view taken along a D-D line of FIG. 12, FIG. 17 shows a front elevation of a state of a film member 16 having been affixed onto the case member 14, FIG. 18 shows a front elevation of a state of a recording head module 3 and a pressure damper module 4 having been connected, and FIG. 20 used for the first embodiment also shows an exploded perspective view of one example of a recording head body 8 according to the second embodiment.

In the same manner as FIG. 20 described above for the first embodiment, FIG. 20 shows the recording head body 8 in the second embodiment upside down. That is, a nozzle plate 801 placed at the top corresponds to the under surface of the recording head body 8. According to the second embodiment, as shown in FIG. 20, head part ink supply pipes 11-1 and 11-2 (instead of the ink supply pipe 11 and the head part air vent pipe 12 of the first embodiment), communicating with a common ink passage 805 at both ends thereof, respectively, are formed in a rigid plate 812. Since the structure of the second embodiment is the same as the structure of the first embodiment described above using FIG. 20, duplicate description thereof will be omitted.

Also in the case of the second embodiment, the pressure damper module 4 has the case member 14 made of a mold of synthetic resin such as polyethylene, and a recess part 15 (see FIG. 12) is formed in the pressure damper module 4 from the front side in such a manner that almost all of the pressure damper module 4 is hollowed out. The front opening of the recess part 15 is closed by a flexible film member 16 made of synthetic resin (see FIG. 17), and thus, an ink containing chamber 17 is formed inside the case member 14.

An ink supply pipe insertion hole 20 for pressing and mounting a pressure damper part ink supply pipe 18 (see FIG. 18) is formed at one end of an upper part in a gravity direction of the case member 14. As shown in FIGS. 12 and 15, a communicating hole 50 formed from an opening of the lower end of the ink supply pipe insertion hole 20 communicates with the recess part 15 (ink containing chamber 17).

Projections 21-1 and 21-2 are formed to project outward as being perpendicular to the gravity direction (vertical direction) at both ends of the upper part of the case member 14, respectively. At lower ends of the projections 21, pressure damper part ink discharge pipe insertion holes 23-1 and 23-2 are formed for pressing thereinto to mount pressure damper part ink discharge pipes 24-1 and 24-2 (see FIG. 18), respectively.

As shown in FIGS. 12 and 18, in order to direct ink 51 contained inside the ink containing chamber 17 toward the pressure damper part ink discharge pipes 24-1 and 24-2 at both sides, a groove-shape taking-out port 52 is formed approximately at the center of an upper part in the gravity direction of the ink containing chamber 17. Distribution grooves 53-1 and 53-2 extend horizontally to both sides of the taking-out port 52, then bend downward at the projections 21-1 and 21-2, and communicate with the pressure damper part ink discharge pipe insertion holes 23-1 and 23-2, respectively.

Since, as shown in FIGS. 15 and 18, the distribution groove 53-2 passes by (intersects separately) a front side of the communicating hole 50, an ascending inclined surfaces 54-1 and 54-2 are formed on the bottoms of the grooves 53-1 and 53-2 near the taking-out port 52 (see FIG. 14). Further, near the pressure damper part ink discharge pipe insertion holes 23-1 and 23-2, descending inclined surfaces 55-1 and 55-2 are formed (see FIG. 16) on the bottoms of the groves 53-1 and 53-2. As shown in FIG. 18, the pressure damper part ink discharge pipes 24-1 and 24-2 on both sides are placed in step parts 44-1 and 44-2 formed on both sides of the case member 14 below the projections 21-1 and 21-2, respectively.

Further, as shown in FIG. 18, on both sides of the recording head body 8, the head part ink supply pipes 11-1 and 11-2 are pressed and mounted. Flexible head-side ink supply tubes 37-1 and 37-2 are provided to connect the head part ink supply pipes 11-1 and 11-2 and the pressure damper part ink discharge pipes 24-1 and 24-2, respectively. The head-side ink supply tubes 37-1 and 37-2 on both sides extend from the pressure damper module 4 to the recording head module 3 approximately straightly.

In this configuration, when ink is supplied, the ink is charged into the pressure damper module 4 and the recording head module 3 in the stated order of the ink tank 75 (see FIG. 10) on the body side of the ink-jet recording apparatus, the tank-side ink supply tube 37*b*, the pressure damper part ink supply pipe 18, the ink containing chamber 17 of the pressure damper module 4, the groove-shape taking-out port 52, the distribution grooves 53-1 and 53-2, the pressure damper part ink discharge pipes 24-1 and 24-2, the head-side ink supply tubes 37-1 and 37-2, the head part ink supply pipes 11-1 and 11-2 and the ink passage of the recording head module 3.

Therefore, in the recording head module 3, the head-side ink supply tubes 37-1 and 37-2 are placed on both sides of the recording head body 8, as shown in FIG. 18. Also in the pressure damper module 4, the head-side ink supply tubes 37-1 and 37-2 are placed on both sides of the case member 14.

Thus, the ink-jet recording head according to the second embodiment is different from a configuration in the related art in which connection members such as the tubular connection part 108 and the ink supply needle 109 are inserted between the recording head part 101 and the pressure damper part 102 as in the ink-jet recording head in the related art shown in FIG. 19. Therefore, it is possible to reduce the height of a carriage 77.

Further, at a time of printing, since the ink 51 can be supplied to the recording head body 8 from both sides (via the head-side ink supply tubes 37-1 and 37-2), it is possible to carry out high-speed printing. Further, the flexible head-side ink supply tubes 37-1 and 37-2 on both sides of the recording head body 8 provide the damper effect, in addition to the ink containing chamber 17 having the film member 16.

It is to be noted that the other configurations of the ink-jet recording head and the ink-jet recording apparatus according to the second embodiment which have not been described are approximately the same as those of the first embodiment, and thus, duplicate description will be omitted.

According to the embodiments, it is possible to provide ink-jet recording heads in which it is possible to effectively control a pressure fluctuation in ink.

Although the ink-jet recording heads have been described by the embodiments, the present invention is not limited to the specifically disclosed embodiments, and variations and modifications may be made without departing from the scope of the present invention.

The present patent application is based on and claims the benefit of priority of Japanese Priority Application No. 2012-192325 filed on Aug. 31, 2012, and Japanese Priority Application No. 2013-171508 filed on Aug. 21, 2013, the entire contents of which are hereby incorporated herein by reference.

What is claimed is:

1. An ink-jet recording head comprising a recording head and pressure damper assembly module that includes a recording head part that has a recording head body, a plurality of nozzle holes on an under surface of the recording head body, and an ink passage communicating with the plurality of nozzle holes, and a pressure damper part that has an ink containing chamber inside, wherein the recording head part is mounted at a position of a lower side in a gravity direction, and the pressure damper part is placed higher in the gravity direction than the recording head part, and the ink-jet recording head further comprises:

a first flexible tube for supplying ink contained in the ink containing chamber of the pressure damper part to the ink passage of the recording head part, the first flexible tube connecting an ink discharge part communicating with the ink containing chamber of the pressure damper part and an ink supply part at one end side in the recording head part and communicating with one end of the ink passage, and a second flexible tube connected with another end side in the recording head part and communicating with another end of the ink passage, wherein at least the inside of the first flexible tube is filled with the ink, and wherein the first flexible tube and the second flexible tube are disposed external to respective side of the recording head body in a horizontal direction perpendicular to the gravity direction.

2. The ink-jet recording head as claimed in claim 1, wherein the second flexible tube functions as an air vent tube for discharging an internal air to the outside of the ink-jet recording head at a time of charging the ink from the pressure damper part to the recording head part.

3. The ink-jet recording head as claimed in claim 2, wherein the ink containing chamber in the pressure damper part is formed in a case member as a result of a front opening of a recess formed in the case member being closed by a flexible synthetic-resin-made film member, a projection projecting outward in a direction perpendicular to the gravity direction is provided at one end of an upper part in the gravity direction of the case member, and an ink discharge passage communicating with the ink containing chamber is formed inside the projection, a pressure damper part ink discharge pipe is placed in a step part formed on a side of the case member below the projection in the gravity direction, and the ink supply part provided at the one end side in the recording head part includes a head part ink supply pipe, the pressure damper part ink discharge pipe and the head part ink supply pipe being connected by the first flexible tube.

4. An ink-jet recording apparatus, comprising the ink-jet recording head claimed in claim 3.

5. An ink-jet recording apparatus, comprising the ink-jet recording head claimed in claim 2.

6. The ink-jet recording head as claimed in claim 1, wherein when air bubbles are to be discharged, a waste tank is connected with the second flexible tube via a suction pump.

7. An ink-jet recording apparatus, comprising the ink-jet recording head claimed in claim 6.

8. The ink-jet recording head as claimed in claim 1, wherein the second flexible tube functions as an ink supply tube for supplying the ink contained in the ink containing chamber of the pressure damper part to the ink passage of the recording head part, the ink supply tube connecting another ink discharge part communicating with the ink containing chamber of the pressure damper part and another ink supply part provided at the other end side in the recording head part and communicating with the other end of the ink passage.

9. The ink-jet recording head as claimed in claim 8, wherein the ink containing chamber in the pressure damper part is formed in a case member as a result of a front opening of a recess formed in the case member being closed by a flexible synthetic-resin-made film member, projections projecting outward in directions perpendicular to the gravity direction are provided at both ends of an upper part in the gravity direction of the case member, and ink discharge passage parts communicating with the ink containing chamber are formed inside the respective projections, pressure damper part ink discharge pipes are placed in step parts formed on both sides of the case member below the projections in the gravity direction, and the one and the other ink supply parts provided at the one and the other end sides of the recording head part are head part ink supply pipes, the pressure damper part ink discharge pipes and the head part ink supply pipes being connected by the first flexible tube and the second flexible tube.

10. An ink-jet recording apparatus, comprising the ink-jet recording head claimed in claim 9.

11. An ink-jet recording apparatus, comprising the ink-jet recording head claimed in claim 8.

12. An ink-jet recording apparatus, comprising the ink-jet recording head claimed in claim 1.

13. The ink-jet recording head as claimed in claim 1, wherein the ink containing chamber in the pressure damper part is formed in a case member as a result of a front opening of a recess formed in the case member being closed by a flexible synthetic-resin-made film member, a projection projecting outward in a direction perpendicular to the gravity direction is provided at one end of an upper part in the gravity direction of the case member, and an ink discharge passage communicating with the ink containing chamber is formed inside the projection, a pressure damper part ink discharge pipe is placed in a step part formed on a side of the case member below the projection in the gravity direction, and the ink supply part provided at the one end side in the recording head part includes a head part ink supply pipe, the pressure damper part ink discharge pipe and the head part ink supply pipe being connected by the first flexible tube.

14. The ink-jet recording head as claimed in claim 1, wherein the ink containing chamber in the pressure damper part is formed in a case member as a result of a front opening of a recess formed in the case member being closed by a flexible synthetic-resin-made film member, a projection projecting outward in a direction perpendicular to the gravity direction is provided at one end of an upper part in the gravity direction of the case member, and an ink discharge passage communicating with the ink containing chamber is formed inside the projection, a pressure damper part ink discharge pipe is placed in a step part formed on a side of the case member below the projection in the gravity direction.

15. An ink-jet recording head comprising a recording head and pressure damper assembly module that includes a recording head part that has a plurality of nozzle holes on an under surface and an ink passage communicating with the plurality of nozzle holes, and a pressure damper part that has an ink containing chamber inside, wherein the recording head part is mounted at a position of a lower side in a gravity direction, and the pressure damper part is placed higher in the gravity direction than the recording head part, and the ink-jet recording head further comprises:

a first flexible tube for supplying ink contained in the ink containing chamber of the pressure damper part to the ink passage of the recording head part, the first flexible tube connecting an ink discharge part communicating with the ink containing chamber of the pressure damper part and an ink supply part at one end side in the recording head part and communicating with one end of the ink passage, and a second flexible tube connected with another end side in the recording head part and communicating with another end of the ink passage, wherein at least the inside of the first flexible tube is filled with the ink, and wherein the ink containing chamber in the pressure damper part is formed in a case member as a result of a front opening of a recess formed in the case member being closed by a flexible synthetic-resin-made film member, a projection projecting outward in a direction perpendicular to the gravity direction is provided at one end of an upper part in the gravity direction of the case member, and an ink discharge passage communicating with the ink containing chamber is formed inside the projection, and a pressure damper part ink discharge pipe is placed in a step part formed on a side of the case member below the projection in the gravity direction.

* * * * *

UNITED STATES PATENT AND TRADEMARK OFFICE

CERTIFICATE OF CORRECTION

PATENT NO. : 9,004,656 B2
APPLICATION NO. : 13/975669
DATED : April 14, 2015
INVENTOR(S) : Hiroshi Takahagi et al.

It is certified that error appears in the above-identified patent and that said Letters Patent is hereby corrected as shown below:

Replace the foreign application priority data on the title page of the patent, with the following:

-- (30) Aug. 31, 2012 (JP) ..... 2012-192325
Aug. 21, 2013 (JP) ..... 2013-171508 --

Signed and Sealed this
Eleventh Day of August, 2015

Michelle K. Lee

Michelle K. Lee
*Director of the United States Patent and Trademark Office*